US010257904B2

(12) United States Patent
Qiu et al.

(10) Patent No.: US 10,257,904 B2
(45) **Date of Patent: *Apr. 9, 2019**

(54) DIM TO WARM CONTROLLER FOR LEDS

(71) Applicant: LUMILEDS LLC, San Jose, CA (US)

(72) Inventors: Yifeng Qiu, San Jose, CA (US); Jeroen Den Breejen, San Jose, CA (US)

(73) Assignee: LUMILEDS LLC, San Jose, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/026,525

(22) Filed: Jul. 3, 2018

(65) Prior Publication Data

US 2018/0317297 A1 Nov. 1, 2018

Related U.S. Application Data

(63) Continuation of application No. 15/498,231, filed on Apr. 26, 2017, now Pat. No. 10,034,346.
(Continued)

(30) Foreign Application Priority Data

Jun. 6, 2016 (EP) ..... 16173125

(51) Int. Cl.
*H05B 33/08* (2006.01)
*H05B 37/02* (2006.01)

(52) U.S. Cl.
CPC ..... *H05B 33/0866* (2013.01); *H05B 33/083* (2013.01); *H05B 33/086* (2013.01); *H05B 33/0827* (2013.01); *H05B 33/0857* (2013.01)

(58) Field of Classification Search
None
See application file for complete search history.

(56) References Cited

U.S. PATENT DOCUMENTS 10,034,346 B2 * 7/2018 Qiu ..... H05B 33/0827
2009/0200955 A1 8/2009 Maros et al.
(Continued)

FOREIGN PATENT DOCUMENTS

| | | |
|---|---|---|
| EP | 2523534 | 11/2012 |
| WO | 10103480 | 9/2010 |
| WO | 17114146 | 7/2017 |

OTHER PUBLICATIONS

EP Search Report, EP Patent Application No. 16 173 125.2, dated Dec. 16, 2016, 6 pages.

*Primary Examiner* — Dedei K Hammond
(74) *Attorney, Agent, or Firm* — Volpe and Koenig, PC

(57) ABSTRACT

A control circuit for a light emitting diode (LED) lighting system for achieving a dim-to-warm effect is provided. The control circuit includes an LED controller, a clamp circuit coupled to a set of warm correlated-color-temperature ("CCT") LEDs, a switch coupled to a set of cool LEDs, and a feedback circuit coupled to the clamp and the switch. The LED controller is configured to control the clamp circuit to clamp current through the set of warm LEDs based on the input current, and control the switch to switch on the set of cool LEDs responsive to the input current being greater than a first threshold level and to switch off the set of cool LEDs responsive to the input current being lower than the first threshold level. The feedback circuit is configured to divert current from the set of warm LEDs to the set of cool LEDs.

20 Claims, 4 Drawing Sheets

Related U.S. Application Data

(60) Provisional application No. 62/328,523, filed on Apr. 27, 2016.

(56) References Cited

U.S. PATENT DOCUMENTS

| | | | |
|---|---|---|---|
| 2009/0207604 | A1 | 8/2009 | Robotham |
| 2012/0038292 | A1 | 2/2012 | Kuo et al. |
| 2013/0020956 | A1 | 1/2013 | Zhang et al. |
| 2013/0063035 | A1 | 3/2013 | Baddela et al. |
| 2014/0210357 | A1 | 7/2014 | Yan et al. |
| 2017/0034883 | A1 | 2/2017 | Roberts et al. |

* cited by examiner

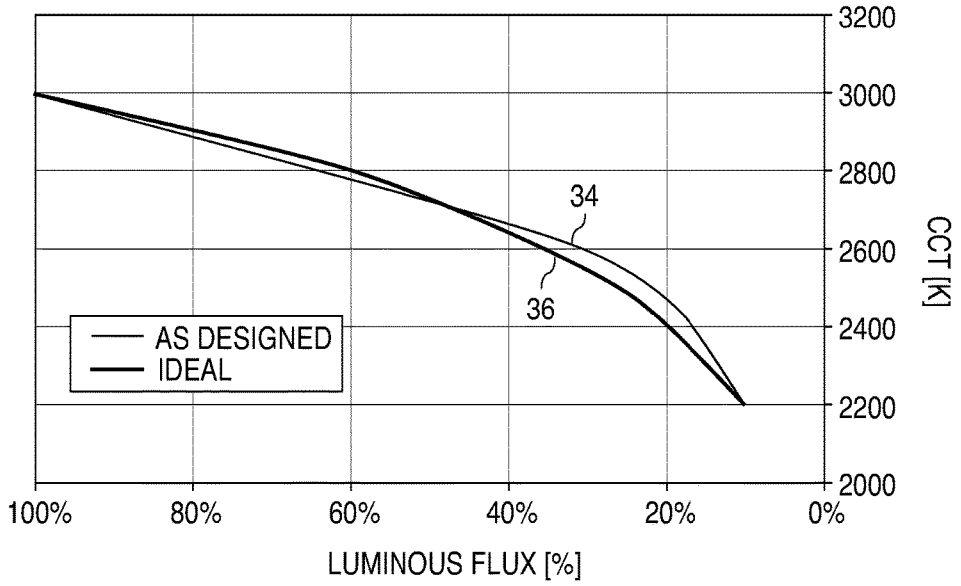
FIG. 5
FIG. 6B
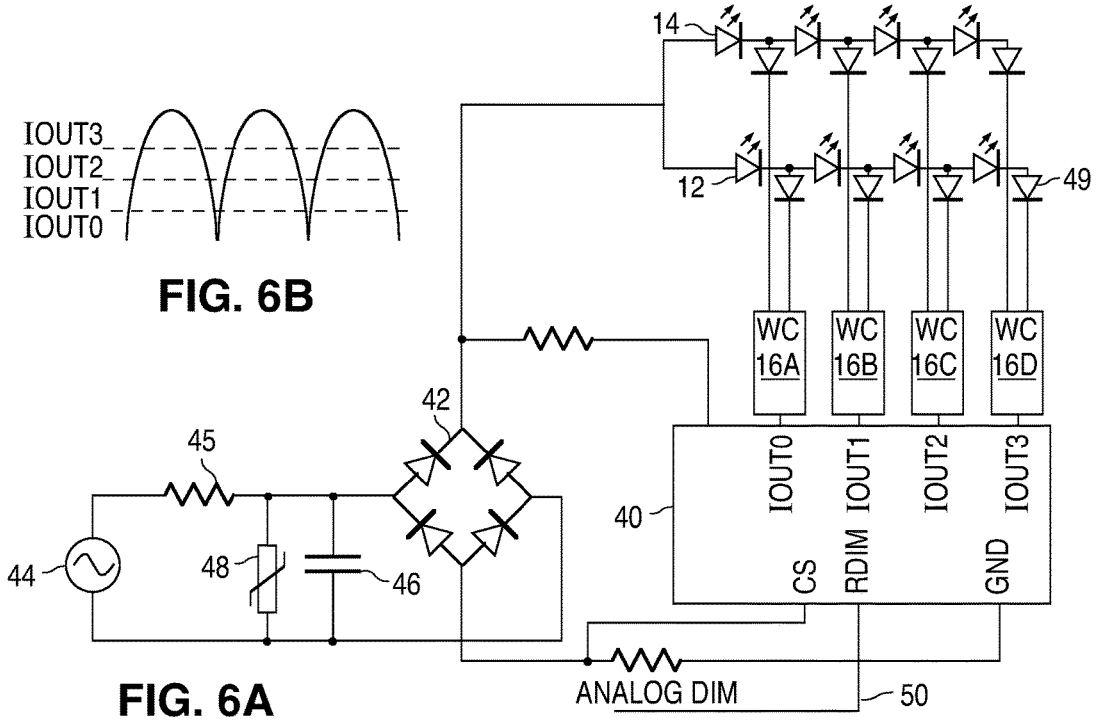
FIG. 6A

DIM TO WARM CONTROLLER FOR LEDS

CROSS-REFERENCE TO RELATED PATENT APPLICATION

This application claims the benefit of U.S. Provisional Application No. 62/328,523 filed on Apr. 27, 2016, European Provisional Application No. 16 173 125.2 filed on Jun. 6, 2016, and U.S. Non-Provisional Application Ser. No. 15/498,231 filed on Apr. 26, 2017, the content of which is hereby incorporated by reference herein as if fully set forth.

FIELD OF THE INVENTION

This invention relates to general lighting using light emitting diodes (LEDs) and, in particular, to a technique to cause LED light to be progressively warmer (have a lower CCT) as the LED light is dimmed by a dimmer.

BACKGROUND

Incandescent bulbs have aesthetically pleasing lighting characteristics. For example, incandescent bulbs get progressively redder (warmer) as the user dims the light by controlling a dimmer to reduce the average current through the bulb. Although many advancements are being made in LED technology, further advancements to help achieve the quality of light typically provided by incandescent bulbs is desirable.

SUMMARY

A control circuit for a light emitting diode (LED) lighting system for achieving a dim-to-warm effect between a minimum brightness-maximum dimming level, and a maximum brightness-minimum dimming level is provided. The control circuit includes an LED controller, a clamp circuit coupled to a set of warm correlated-color-temperature ("CCT") LEDs, a switch coupled to a set of cool CCT LEDs, and a feedback circuit coupled to the clamp and the switch. The LED controller is configured to sense the magnitude of an adjustable input current, control the clamp circuit to clamp current through the set of warm CCT LEDs to a clamp current level based on the input current, and control the switch to switch on the set of cool CCT LEDs responsive to the input current being greater than a first threshold level and to switch off the set of cool CCT LEDs responsive to the input current being lower than the first threshold level. Responsive to the input current exceeding a second threshold level, the feedback circuit is configured to divert current from the set of warm CCT LEDs to the set of cool LEDs.

BRIEF DESCRIPTION OF THE DRAWINGS

FIG. 5 is a graph showing the simulated overall CCT of the lamp as the light is dimmed from the maximum to the minimum, as well as showing the ideal CCT of a halogen bulb.

FIGS. 6A-6B illustrate an embodiment of the invention, where the input currents into four dim-to-warm circuits are provided by a tapped linear driver receiving an analog dimming signal, and where four dim-to-warm circuits are used and designed to each create the same CCT at the same dimming level.

Elements that are the same or similar are labeled with the same numeral.

DETAILED DESCRIPTION

Figure 1:
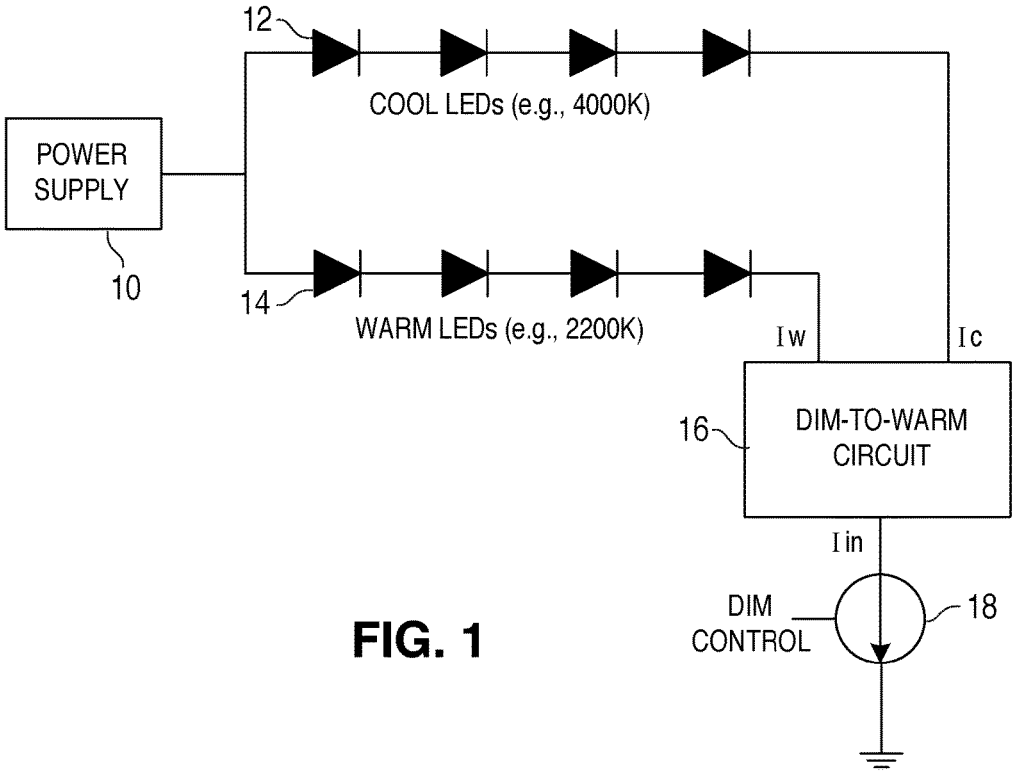
FIG. 1 illustrates a string of warm LEDs and a string of cool LEDs, both emitting white light, and further illustrates a dim-to-warm circuit that controls the currents to each string as the input voltage varies from a minimum current to a maximum current.

In one embodiment, two series strings of LEDs are used in a lamp. The first string contains identical cool LEDs, such as GaN-based LEDs with a tuned phosphor that results in a CCT of 4000K. The second string contains identical warm LEDs, such as using the same GaN-based LED dies as the cool LEDs but using a tuned phosphor the results in a CCT of 2200K. In other embodiments, the number of strings and CCTs may be different. Both CCTs are considered white light.

A power supply, such as a rectified mains voltage, is applied to one end of the two strings, and the other ends of the two strings are connected to different terminals of a dim-to-warm circuit.

An adjustable analog (not PWM) current is supplied to an input of the dim-to-warm circuit, where the input current level may be adjusted by a user controlling a suitable light dimmer.

Between the minimum input current and a first input current level, the cool LED string is disconnected by a switch, and all the input current flows through the warm LED string. Therefore, the dimming solely controls the brightness of the warm LEDs up to the first input current level. The CCT output of the lamp is a constant warm temperature up to the first input current level.

As the input current is adjusted above the first input current level, but below a second input current level, the switch is closed and a portion of the input current flows through the cool LED string, while current through the warm LED string is clamped to a constant current. Therefore, within this range of input currents, the dimming solely controls the brightness of the cool LEDs while the brightness of the warm LEDs stays constant. The CCT output of the lamp is a varying mixture of the two CCTs, with the CCT increasing as the input current approaches the second input current level.

As the input current is adjusted above the second input current level to the maximum current, the cool LEDs remain controlled by the increasing input current, while the current to the warm LEDs is progressively reduced to zero at the maximum input current. The CCT output of the lamp thus approaches the CCT of the cool LEDs as the input current level approaches its maximum.

Using this technique, the full range of CCTs, from 4000K-2200K is obtained and, since both sets of LEDs output a white light, there is a more natural combination of light from the different LEDs producing the varying CCT. Since the operation is linear (no PWM or high frequency switching), no EMI is generated and no filters are needed. Since the operation is linear, very small linear regulators can be used to create the input current, including a tapped linear regulator.

In one embodiment, a tapped linear driver is used as the driver for the dim-to-warm circuit. The tapped linear regulator receives a voltage from a full wave diode bridge rectifying the AC mains voltage and successively supplies current to different segments of the two LED strings as the DC voltage varies at double the AC frequency. This results in a very compact and efficient control system.

FIG. 1 illustrates one embodiment. A power supply 10 may be a rectified mains voltage, a battery, a regulator, or any other source. A series string of white-light cool LEDs 12 has its anode end coupled to the power supply 10, and a series string of white-light warm LEDs 14 also has its anode end coupled to the power supply 10. There may be multiple strings of each type of LED, depending on the desired maximum light output of the lamp, and the strings for each type of LED may be connected in parallel so that the strings of each type of LED are controlled identically.

The cool LEDs may be conventional, commercially available, GaN-based LED dies, emitting blue light, with a suitable phosphor deposited over the die, such as a YAG phosphor. Other phosphors may be used. Such cool LEDs 12 will typically have a CCT in the range of 3000-6000K. In the example, the CCT is 4000K.

The warm LEDs 14 may be conventional, commercially available, GaN-based LED dies, emitting blue light, with a suitable phosphor deposited over the die, such as a YAG phosphor plus a warmer phosphor emitting amber or red light. Other phosphors may be used. Such warm LEDs 14 will typically have a CCT in the range of 1900-2700K. In the example, the CCT is 2200K.

Since the warm and cool LED dies may be the same type of die, they have the same forward voltage drops. In one embodiment, the same number of LEDs is in each of the strings so the strings have the same forward voltage drops.

The relative brightnesses (luminous flux) of the cool LEDs 12 and warm LEDs 14 are determined by a dim-to-warm circuit 16. The dim-to-warm circuit 16 may be a 3-terminal circuit that outputs the separate drive currents for the warm LEDs 14 (Iw) and the cool LEDs 12 (Ic). The input into the dim-to-warm circuit 16 is an adjustable analog current (input current Iin) from an external current source 18 that sets the overall dimming of the lamp. A low input current Iin results in a low overall brightness of the lamp that has a relatively low CCT, and a high input current IM results in a high overall brightness of the lamp with a relatively high CCT.

Figure 2:
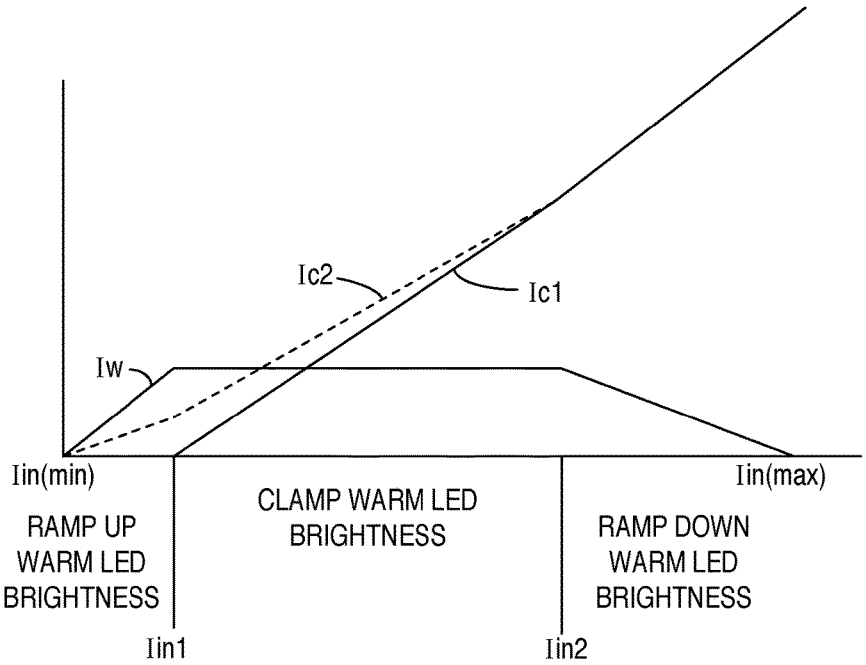
FIG. 2 is an example of the relative currents supplied to the warm LEDs (Iw) and the cool LEDs (Ic) over the full range of input currents.

FIG. 2 illustrates the current Iw through the warm LEDs 14 (directly corresponding to the brightness of the warm LEDs 14) and the current Ic1 or Ic2 through the cool LEDs 12 (directly corresponding to the brightness of the cool LEDs 12) through the full range of input currents Iin. The current Ic1 represents a current where the cool LEDs 12 are completely off between the minimum input current Iin (min) and an intermediate input current Iin1, and the current Ic2 represents a current where the cool LEDs 12 are somewhat on between Iin(min) and Iin1 so the CCT change is continuous throughout the entire Iin range. The dim-to-warm circuit 16 can be designed to achieve the Ic1 or Ic2 current curve.

The minimum input current Iin(min) corresponds to a maximum dimming level (least bright and most warm), and the maximum input current Iin(max) corresponds to a minimum dimming level (most bright and most cool).

The following description assumes the dim-to-warm circuit 16 outputs the current Ic1. Between Iin(min) and Iin1, the dim-to-warm circuit 16 only outputs the current Iw to drive the warm LEDs 14 with a current proportional to the adjustable input current Iin, so the CCT output of the lamp is 2200K. Between Iin1 and In2, the dim-to-warm circuit 16 clamps Iw so that the brightness of the warm LEDs 14 is relatively constant, while Ic1 rises proportional to the input current Iin. Therefore, between Iin1 and Iin2, the overall (perceived) CCT output of the lamp will become increasing cooler. Between Iin2 and Iin(max), Iw ramps down, while Ic1 still rises proportional to the input current Iin. The overall CCT of the lamp at the various dimming levels generally matches the varying CCT of a halogen lamp or incandescent bulb.

Figure 3:
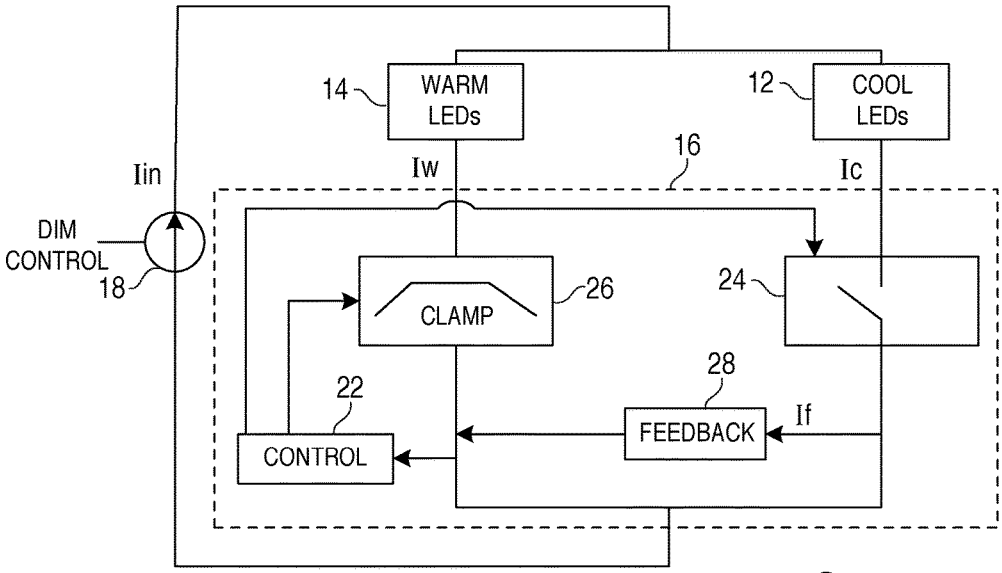
FIG. 3 illustrates various functional units in the dim-to-warm circuit of FIG. 2.

FIG. 3 illustrates the overall system showing the dim-to-warm circuit 16, the string of warm LEDs 14, the string of cool LEDs 12, and the dimming control adjustable current source 18 outputting Iin.

At an Iin below Iin1, a control circuit 22 (a comparator) keeps a switch 24 off so that no current flows through the cool LEDs 12 and all the input current En flows through the warm LEDs 14.

When Iin exceeds Iin1, the control circuit 22 turns on the switch 24 so that the current Ic through the cool LEDs 12 is generally proportional to Iin. The control circuit 22 also controls a clamp circuit 26 to clamp the current Iw to a fixed level so that the brightness of the warm LEDs 14 does not change between Iin1 and Iin2 (FIG. 2).

When the input current exceeds Iin2, a feedback circuit 28 becomes forward biased to progressively divert some current to the left leg of the circuit, which controls the clamp 26 to progressively reduce the current Iw through the warm LEDs 14.

The resulting Iw and Ic currents in FIG. 3 match the currents Iw and Ic1 in FIG. 2.

Figure 4:
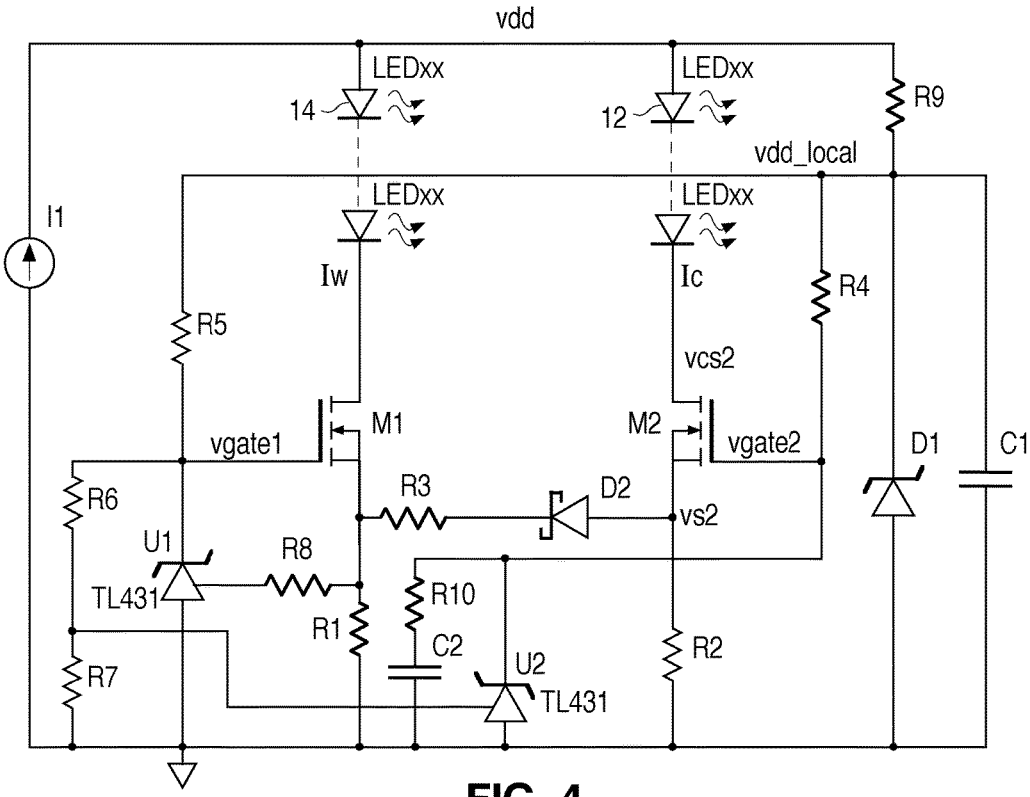
FIG. 4 is a circuit diagram of the dim-to-warm circuit, as well as the warm LEDs and cool LEDs.

FIG. 4 is a schematic circuit diagram of the system of FIG. 3. The circuit of FIG. 4 may be formed as a four-terminal packaged IC, with two of the terminals being coupled to the cathode ends of the series strings of warm and cool LEDs, a third terminal being the vdd local terminal (labeled in FIG. 4), and the fourth terminal being coupled to ground. The adjustable dimming current is coupled to the anodes of the two series strings.

The controllable Zeller diodes U1 and U2 may be the TLV431 adjustable shunt regular by Diodes Inc, whose data sheet is incorporated herein by reference. The preferred adjustable shunt regulator has an 18V cathode-anode rating with a reference voltage (threshold voltage) of 1.25 V. The Zener diode symbol represents the function of the shunt regulator, even though a Zener diode is not required for the shunting. Other controllable shunt regulator circuits may be used. An input control voltage into the diode U1 and U2 controls the clamping voltage. Between the input currents Iin(min) and Iin1 (FIG. 2), the diode U1 is virtually non-conducting, and the gate of the MOSFET M1 is pulled to a high level by the pull-up resistor R5 to turn the MOSFET M1 on. As a result, all the input current En flows through the MOSFET M1 and the warm LEDs 14.

The diode U1, resistors R1, R5, R8, and the MOSFET M1 form a current regulator (the clamp circuit 26), where the gate voltage of the MOSFET M1 determines Iw. The control terminal of the Zener diode U1 is coupled to the top node of resistor R1. In the particular circuit example, when the input current Iin increases the current Iw to the point at which the voltage at the top node of resistor R1 is at 1.25 volts, the Zener diode U1 will conduct to clamp the gate voltage to the level required for conducting the clamped current Iw in FIG. 2. A reference voltage is set in the TL431 (represented by the Zener diode U1) so that a control voltage of 1.25 volts causes the Zener diode U1 to conduct sufficiently to maintain the voltage of 1.25 at the top node of resistor R1. Prior to the control voltage reaching 1.25 volts, the Zener diode U1 is off. The clamping by the Zener diode U1 begins at Iin1 in FIG. 2. Thus, between Iin1 and In2, the current Iw flowing through the MOSFET M1 will be clamped to 1.25V/R1. So the value of R1 determines the location of Iin1. Although a particular value of 1.25 volts for the control voltage is described, any technically feasible control voltage may be used.

The resistors R6, R7 and a second adjustable Zener diode U2 (another TL431) behave as a comparator which monitors the gate voltage of MOSFET M1. Before the current Iw through resistor R1 reaches the clamp current, the Zener diode U1 draws minimum current.

Resistor R5 is connected to a certain fixed voltage set by a Zener diode D1 (and filtered by capacitor C1) and pulls the gate of MOSFET M1 high, where the gate voltage is equal to (R6+R7)/(R5+R6+R7) multiplied by the voltage set by the Zener diode D1. When the current through MOSFET M1 reaches the clamp current of the regulator (at Iin1), the Zener diode U1 (the TL431) conducts to pull the gate voltage to the required level to clamp the current through MOSFET M1. This lowers the voltage at the resistive divider formed of resistors R6 and R7, and the divided voltage lowers the control voltage into the controllable Zener diode U2 (a TL431) to below its threshold voltage to cause the Zener diode U2 to act as an open circuit. By doing so, resistor R4 pulls the gate voltage of the MOSFET M2 (the switch 24 in FIG. 3) high, which turns on the MOSFET M2 at the input current Iin1. As the change of gate voltage is relatively large before and after the current through resistor R1 reaches the clamp current, this circuit is rather insensitive to the spread of the internal reference threshold voltage of the TL431 adjustable shunt regulator. More specifically, if one tries to design a fixed turn-on threshold of MOSFET M2 to match the internal reference voltage of the TL431 adjustable shunt regulator, mismatch can occur due to the spread of the reference voltage. With the techniques provided herein, the M2 turn-on threshold does not try to follow the absolute value of the internal reference voltage of the TL431 adjustable shunt regulator and is thus insensitive to that spread.

Capacitor C2 and resistor R10 form a compensation network for maintaining closed-loop stability.

The operation at the input current Iin2 will now be described. Resistor R3 and Schottky diode D2 form the feedback circuit 28 in FIG. 3. As soon as the source voltage of MOSFET M2 is higher than the source voltage of MOSFET M1 by the forward voltage of the Schottky diode D2, some current will be diverted through resistors R3 and R1. The current through resistor R1 now consists of currents from both the resistor R3 and MOSFET M1. This is the knee point at Iin2 in FIG. 2 and the onset of the roll off of the current Iw in MOSFET M1. The added current through resistor R1 causes the Zener diode U1 to further reduce the gate voltage of the MOSFET M1 to maintain the voltage at the top node of resistor R1 to 1.25 volts. A larger resistor R2 moves Iin2 to the left on the x axis. The slope of the roll-off is determined by the resistor R3. The higher the value of the resistor R3, the less steep the slope. The Zener diodes U1 and U2 and the resistors R6, R7, R4, and R2 perform functionality of the control circuit 22 (also referred to as an "LED controller"). More specifically, the control circuit 22, controls the switch 24 (the MOSFET M2) to allow or disallow current flow through the cool LEDs 12 and controls the clamp circuit 26 (the current regulator including Zener diode U1, resistors R1, R5, R8, and MOSFET M1) to clamp current through the warm LEDs 14, as specified above. Note that although the control circuit 22 and the clamp 26 are described as including certain components of the circuit shown in FIG. 4, in at least some respects, the boundary between control circuit 22 and clamp circuit 26 is not perfectly delineated. For example, although resistors R6 and R7 are described as being part of the control circuit 22 and resistor R5 is described as being part of the clamp circuit 26, these resistors cooperate to perform functions of both the control circuit 22 and the clamp circuit 26. Those of skill in the art will recognize that the various elements illustrated in FIG. 4 could be grouped in different ways to correspond to the elements of FIG. 3.

Resistor R9, diode D1, and capacitor C1 form a voltage buffer. It makes sure that the gate voltages of both MOSFETs are within their limit and the result of the resistive divider (R5, R6, R7) is predictable.

If it is not desired to completely turn off the cool LEDs 12 at an input current below Iin1, the MOSFET M2 can be controlled to roll off between Iin(min) and Iin1, as shown by the Ic2 line in FIG. 2. This can be done by connecting a resistor between the nodes vcs2 and vs2 as a leakage path in parallel with the MOSFET M2.

FIG. 5 illustrates how the resulting CCT output 34 of the lamp is virtually identical to the ideal CCT of a halogen bulb while dimming between 100% and about 10% (minimum dimming).

The inventive system requires no high frequency filters and can be made very compact and inexpensively. It can be used with any type of dimming circuit that adjusts the analog input current.

FIG. 6A shows the use of the dim-to-warm circuit 16 with a tapped linear LED driver 40. Tapped linear LED drivers that operate from an AC mains voltage are well known and commercially available. The driver 40 may be a MAP9010 AC LED driver 40 by MagnaChip or other suitable driver.

The driver 40 receives a rectified AC signal from a full wave diode bridge 42. The AC signal may be a mains voltage 44. A fuse 45 (represented by a resistor symbol) protects the circuit from overcurrents, a capacitor 46 smooths transients, and a transient suppressor 48 limits spikes. The driver 40 senses the increasing and decreasing levels of the incoming DC signal and successively applies currents to its four outputs IOUT0-IOUT3, as shown in FIG. 6B. Only one current is output on any of the four output terminals at a time, so that, at a low DC voltage level that just exceeds the forward voltage of a first group of series LEDs, only IOUT0 outputs a current to energize the first group of LEDs. At near the highest DC voltage level, which exceeds the forward voltage of the entire string of LEDs, only IOUT3 outputs a current to energize the entire string. The diodes 49 ensure that all currents only flow into the driver 40. The analog driving currents are controlled by a control signal 50, such as from a user-controlled dimmer.

The first group of LEDs on the left side is on the most since those LEDs turn on when the DC voltage rises above the forward voltage of the first group of LEDs, and the fourth group of LEDs on the right side is on the least since those LEDs are only turned on when the DC voltage is near the highest level. The currents progressively increase from IOUT0-IOUT3 to reduce perceptible flicker as the number of energized LEDs constantly changes with the changing DC level. Although only one cool LED 12 and one warm LED 14 are shown in each group, there may be more LEDs in each group.

As a result of the currents IOUT0-IOUT3 being different at the same dimming level, the combination of the currents Ic and Iw to the cool LEDs 12 and warm LEDs 14 is adjusted for each of the dim-to-warm circuits 16A-16D so that the CCT of each group of LEDs at every dimming level is matched to avoid the CCT of the lamp fluctuating each cycle. Matching the CCT at each dimming level is done by adjusting the values of the resistors R1, R2, and R3 (FIG. 4). For example, for the dim-to-warm circuit 16A receiving the IOUT0 current (the lowest) for a particular dimming level where the cool LEDs and warm LEDs are on at the same time, the dim-to-warm circuit 16A applies the same ratio of currents Ic and Iw to the cool LEDs and warm LEDs as the dim-to-warm circuit 16D receiving the IOUT3 current (highest). One skilled in the art can easily select the values of R1, R2, and R3 to maintain equal CCTs for each of the dim-to-warm circuits 16A-16D at any of the dimming levels.

Figure 7:
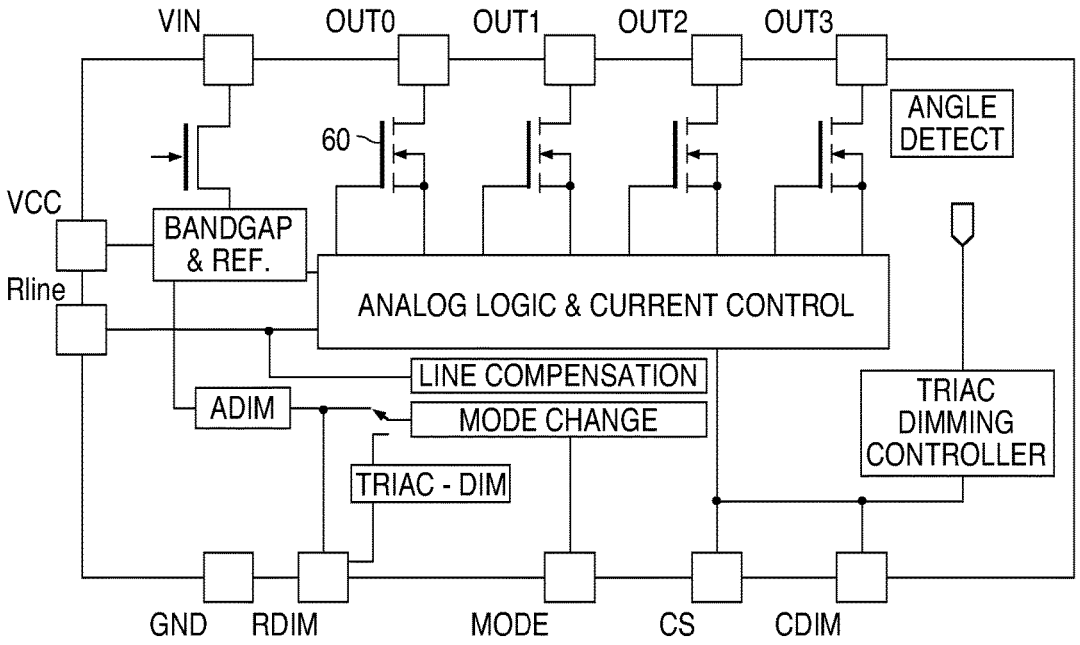
FIG. 7 (Prior Art)
FIG. 7 is a function diagram (from a data sheet) of a suitable prior art tapped linear regulator that may be used in the system of FIG. 6.

FIG. 7 illustrates the functional units in the MAP9010 driver reproduced from its data sheet. The MOSFETs 60 are controlled to successively supply the desired currents at the outputs IOUT0-IOUT3 as the rectified DC voltage varies during the AC cycles. An analog dimming signal is applied to the terminal RDIM to control the currents at the outputs IOUT0-IOUT3. The operation is further described in the data sheet, incorporated herein by reference.

The dim-to-warm circuit 16 described above may be a simple 3-terminal IC that can be used with conventional LED drivers that provide a variable current for dimming. The dim-to-warm circuit 16 requires no high frequency filtering components (e.g., large capacitors or inductors) so it is easily mounted on a printed circuit board with the LEDs. No microprocessor is needed.

While particular embodiments of the present invention have been shown and described, it will be obvious to those skilled in the art that changes and modifications may be made without departing from this invention in its broader aspects and, therefore, the appended claims are to encompass within their scope all such changes and modifications as fall within the true spirit and scope of this invention.

The invention claimed is:

1. A control circuit for a light emitting diode (LED) lighting system for achieving a dim-to-warm effect between a minimum brightness-maximum dimming level, and a maximum brightness-minimum dimming level, the control circuit comprising:

a clamp circuit coupled to a set of warm correlated-color-temperature ("CCT") LEDs;

a switch coupled to a set of cool CCT LEDs;

an LED controller configured to:

control the clamp circuit to clamp current through the set of warm CCT LEDs to a clamp current level based on an input current; and a feedback circuit coupled to the clamp circuit and switch, the feedback circuit being configured to cause the clamp circuit to divert current from the set of warm CCT LEDs to the set of cool CCT LEDs in response to the input current exceeding a second threshold level.

2. The control circuit if claim 1, wherein the LED controller is further configured to control the switch to switch on the set of cool CCT LEDs responsive to the input current being greater than a first threshold level and to switch off the set of cool CCT LEDs responsive to the input current being lower than the first threshold level.

3. The control circuit of claim 1, wherein the LED controller is further configured to obtain a magnitude of the input current.

4. The control circuit of claim 1, wherein the clamp circuit comprises:

a first transistor, a first Zener diode, a first resistor, and a second resistor, wherein the first Zener diode is configured to control a gate voltage of the first transistor to clamp current through the set of warm CCT LEDs at the clamp current level, via the first resistor and the second resistor.

5. The control circuit of claim 4, wherein the switch comprises:

a second transistor coupled to the set of cool CCT LEDs.

6. The control circuit of claim 5, wherein the LED controller comprises:

the first Zener diode, a second Zener diode, a third resistor, a fourth resistor, a fifth resistor, and a sixth resistor, wherein the third resistor, the fourth resistor, and the second Zener diode are configured to, responsive to the first Zener diode becoming conductive, cause the second transistor to become conductive.

7. The control circuit of claim 6, wherein the feedback circuit comprises:

a Schottky diode and a seventh resistor, the Schottky diode and seventh resistor configured to, responsive to a source voltage of the second transistor being higher than a source voltage of the first transistor, divert current from the second transistor through the seventh resistor to the first resistor to reduce the gate voltage of the first transistor, thereby reducing current through the set of warm CCT LEDs.

8. The control circuit of claim 7, wherein:

the first resistor is coupled to a control terminal of the first Zener diode and to both the first transistor and to the second resistor, and an anode of the first Zener diode is coupled to a ground terminal and a cathode of the first Zener diode is coupled to a gate of the first transistor.

9. The control circuit of claim 8, wherein:

the second Zener diode is coupled to a gate of the second transistor and to the ground terminal, and a control terminal of the second Zener diode is coupled to the third resistor and the fourth resistor;

the third resistor is coupled to the gate of the first transistor;

the fourth resistor is coupled to the ground terminal and to the third resistor;

the fifth resistor is coupled to a high voltage and to the gate of the second transistor; and the sixth resistor is coupled to the source of the second transistor and to the ground terminal.

10. The control circuit of claim 9, wherein:

the Schottky diode is coupled to the source of the second transistor and to the seventh resistor; and the seventh resistor is coupled to the source of the first transistor.

11. The control circuit of claim 1, wherein:

the warm CCT LEDs have a color temperature of approximately 4000K and the cool CCT LEDs have a color temperature of approximately 2200K.

12. A method for controlling an LED lighting system, the method comprising:

controlling a clamp circuit to clamp current through a set of warm CCT LEDs to a clamp current level based on an input current; and causing the clamp circuit to divert current from the set of warm CCT LEDs to a set of cool LEDs in response to the input current exceeding a second threshold level, by using a feedback circuit that is coupled to the clamp circuit and a switch.

13. The method of claim 12, further comprising controlling a switch to switch on the set of cool CCT LEDs responsive to the input current being greater than a first threshold level and to switch off the set of cool CCT LEDs responsive to the input current being lower than the first threshold level.

14. The method of claim 12, wherein clamping the current comprises:

controlling a gate voltage of a first transistor coupled to the set of warm CCT LEDs at the clamp current level, via a first resistor and a second resistor, wherein:

the first resistor is coupled to a control terminal of a first Zener diode and to both the first transistor and to the second resistor, and an anode of the first Zener diode is coupled to a ground terminal and a cathode of the first Zener diode is coupled to a gate of the first transistor.

15. The method of claim 12, wherein switching on the set of cool CCT LEDs comprises:

causing a second transistor to be conductive responsive to the first Zener diode becoming conductive.

16. The method of claim 15, wherein diverting current from the set of warm CCT LEDs to the set of cool CCT LEDs comprises:

responsive to a source voltage of the second transistor being higher than a source voltage of the first transistor, divert current from the second transistor through a third resistor to a fourth resistor to reduce a gate voltage of the first transistor, thereby reducing current through the set of warm CCT LEDs.

17. A control circuit for a light emitting diode (LED) lighting system, the control circuit comprising:

a clamp circuit coupled to a set of warm correlated-color-temperature ("CCT") LEDs;

a switch coupled to a set of cool CCT LEDs;

an LED controller configured to:

obtain a current magnitude of an adjustable input current;

disconnect the cool CCT LEDs via the switch if the current magnitude is below a first current threshold such that the adjustable input current flows through the set of warm CCT LEDs;

control the clamp circuit to clamp current through the set of warm CCT LEDs to a constant clamp current level if the adjustable input current is adjusted to be above the first current threshold but remains below a second current threshold;

close the switch to enable a portion of the input current to flow through the set of cool CCT LEDs if the adjustable input current is adjusted to be above the first current threshold but remains below a second current threshold;

progressively reduce the current through the set of warm CCT LEDs to zero if the adjustable input current is above the second current threshold and increasing past the second current threshold to a maximum current; and increase the input current flowing to the set of cool CCT LEDs to the maximum current if the adjustable input current is above the second current threshold and increasing past the second current threshold to the maximum current, wherein increasing the input current flowing to the set of cool CCT LEDs comprises diverting the current from the set of warm CCT LEDs to the set of cool CCT LEDs.

18. The control circuit of claim 17, further comprising a feedback circuit coupled to the clamp circuit and switch, the feedback circuit being configured to cause the clamp circuit to divert current from the set of warm CCT LEDs to the set of cool CCT LEDs in response to the input current exceeding the second current threshold level.

19. The control circuit of claim 17, wherein clamping the current comprises:

controlling a gate voltage of a first transistor coupled to the set of warm CCT LEDs at the clamp current level, via a first resistor and a second resistor, wherein:

the first resistor is coupled to a control terminal of a first Zener diode and to both the first transistor and to the second resistor, and an anode of the first Zener diode is coupled to a ground terminal and a cathode of the first Zener diode is coupled to a gate of the first transistor.

20. The control circuit if claim 17, wherein closing the switch to enable a portion of the input current to flow through the set of cool CCT LEDs comprises:

causing a second transistor to be conductive responsive to the first Zener diode becoming conductive.

* * * * *